United States Patent [19]

Kasamatsu et al.

[11] Patent Number: 4,622,566

[45] Date of Patent: Nov. 11, 1986

[54] HEAT-SENSITIVE RECORDING MATERIAL

[75] Inventors: Norikazu Kasamatsu, Kawasaki; Masao Matsukawa, Tokyo; Hirokazu Hirata, Kamifukuoka; Masaru Mishima, Tokyo, all of Japan

[73] Assignee: Sanyo-Kokusaku Pulp Co., Ltd., Tokyo, Japan

[21] Appl. No.: 760,120

[22] Filed: Jul. 29, 1985

[51] Int. Cl.[4] ..... B41M 5/18

[52] U.S. Cl. ..... 346/214; 346/217; 346/221; 427/150; 427/151

[58] Field of Search ..... 346/214, 216, 217, 221, 346/225; 427/150, 151, 152

[56] References Cited

U.S. PATENT DOCUMENTS 4,506,278 3/1985 Sakamoto et al. ..... 346/216

FOREIGN PATENT DOCUMENTS 0195691 12/1982 Japan ..... 346/216

*Primary Examiner*—Bruce H. Hess

*Attorney, Agent, or Firm*—Oblon, Fisher, Spivak, McClelland & Maier

[57] ABSTRACT

A heat-sensitive recording material is disclosed, comprising a support having thereon a heat-sensitive, color-forming layer mainly composed of as color-forming components a colorless or pale-colored leuco dye and an acidic compound capable of allowing said leuco dye to color develop by heating, wherein said heat-sensitive, color-forming layer comprises a color former comprising a fluoran derivative represented by the following general formula (I):

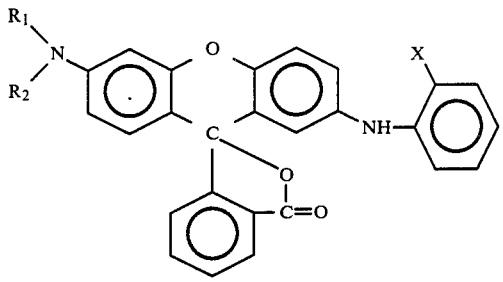

(I)

wherein $R_1$ and $R_2$ each represents a lower alkyl group, and X represents a halogen atom, a lower alkyl group, a cyano group, or a nitro group, a developer comprising bis(p-hydroxyphenyl)sulfone or a derivative thereof represented by the following general formula (II):

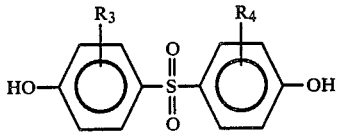

(II)

wherein $R_3$ and $R_4$ each represents a hydrogen atom, an alkyl group, an aryl group, an alkoxy group, a phenoxy group, a carbonyl group, a nitro group, or a cyano group, and a binder comprising an ammonium salt of a diisobutylene/maleic anhydride copolymer and a styrene/butadiene copolymer. The heat-sensitive recording material of the present invention is good in preservability.

2 Claims, No Drawings

HEAT-SENSITIVE RECORDING MATERIAL

FIELD OF THE INVENTION

The present invention relates to a heat-sensitive recording material which is good in environmental stability and, more particularly, it relates to a heat-sensitive recording paper for self-adhesive labels which has no protective layer.

BACKGROUND OF THE INVENTION

Hitherto, heat-sensitive recording papers have been used as a heat-sensitive recording type, self-adhesive label.

In the case of such a heat-sensitive recording type, self-adhesive label, when plasticizers present in plastic films, such as dioctyl adipate (DOA) and dioctyl phthalate (DOP), penetrate into a heat-sensitive, color-forming layer, there was found a problem of decolorization of the printed portion (color-formed portion). Accordingly, it cannot be used as a self-adhesive label for plasticizer-containing plastic wrapping film. Further, when water or oils penetrate into the heat-sensitive, color-forming layer, the printed image smears or the image density reduces with a lapse of time. Moreover, in the case that the printing is carried out by bringing the heat-sensitive, color-forming layer into direct contact with a thermal head, if the amount of a binder present in the heat-sensitive, color-forming layer is too high, the residue build-up and sticking readily occur. Accordingly, in order to prevent such occurrence, the amount of the binder in the heat-sensitive, color-forming layer is necessarily reduced, which, however, leads to a drawback that the surface strength is weak. Thus, in the case that the printing is carried out on the surface of the heat-sensitive, color-forming layer, the heat-sensitive, color-forming layer is entrained in the rubber roll side, whereby the printing is no longer possible.

In order to remove the above drawbacks, an attempt to not only prevent the transfer and penetration of plasticizers, water and oils into the heat-sensitive, color-forming layer but also impart it with a surface strength has hitherto been made by providing a protective layer on the heat-sensitive, color-forming layer for the purpose of adapting such a heat-sensitive recording material to self-adhesive labels.

As a main component of the protective layer, there are used water-soluble high molecular weight compounds such as, for example, polyvinyl alcohol or modified products thereof, starch or modified products thereof, etc.

However, in the case of the conventional heat-sensitive recording type, self-adhesive labels having a protective layer mainly composed of a water-soluble high molecular weight compound, though the decolorization of the printed portion by plasticizers and the surface strength are improved, there may occur the transfer and penetration of water and oils from the edge portions and back side of the label, resulting in decolorization of the printed portion by water and oils. Further, by providing the protective layer on the heat-sensitive, color-forming layer, when the color formation is carried out by means of a thermal head, there occur problems that the heat responsibility reduces and the color formation sensitivity lowers. Still further, because of the increase of a production step for providing the protective layer, there is a disadvantage of cost increase.

SUMMARY OF THE INVENTION

An object of the present invention is to provide a heat-sensitive recording material which can overcome the above-described drawbacks of the conventional techniques and which can not only prevent the decolorization of the color-formed image by plasticizers, water and oils but also be produced at a low manufacturing cost.

In order to achieve the above object, the present inventors have made extensive investigations and found that this object can be attained by a heat-sensitive recording material comprising a heat-sensitive, color-forming layer containing as color-forming components a colorless or pale-colored leuco dye and an acidic compound capable of allowing the leuco dye to color develop by heating, wherein a color former comprising a specified fluoran derivative, a developer comprising a specified sulfone compound, and a binder comprising a specified high molecular weight compound are combined with each other, which finding accomplished the present invention.

That is, the present invention is to provide a heat-sensitive recording material comprising a support having on one surface thereof a heat-sensitive, color-forming layer comprising a color former comprising a fluoran derivative represented by the following general formula (I):

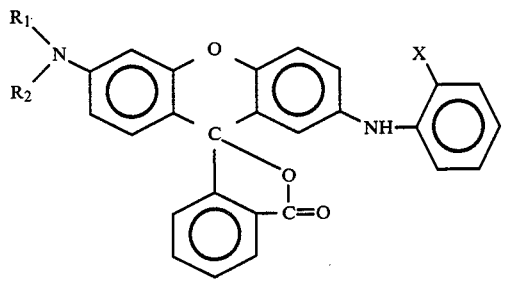

(I)

wherein $R_1$ and $R_2$ each represents a lower alkyl group, and X represents a halogen atom, a lower alkyl group, a cyano group, or a nitro group, a developer comprising bis(p-hydroxyphenyl)sulfone or a derivative thereof represented by the following general formula (II):

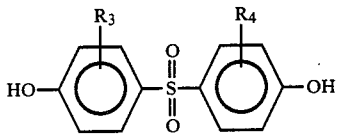

(II)

wherein $R_3$ and $R_4$ each represents a hydrogen atom, an alkyl group, an aryl group, an alkoxy group, a phenoxy group, a carbonyl group, a nitro group, or a cyano group, and a binder comprising an ammonium salt of a diisobutylene/maleic anhydride copolymer and a styrene/butadiene copolymer.

In the heat-sensitive recording material according to the present invention, the printing or recording of images can be carried out on one side of the support in a heating manner, and when a self-adhesive layer is provided on the other side of the support, the heat-sensitive recording material can be used as various price labels, measuring labels, name plates, seals, etc.

DETAILED DESCRIPTION OF THE INVENTION

Examples of the fluoran derivative represented by the above-described general formula (I) include 3-dibutylamino-7-o-chloroanilinofluoran, 3-dibutylamino-7-o-fluoroanilinofluoran, 3-diethylamino-7-o-chloroanilinofluoran, and 3-diethylamino-7-o-fluoroanilinofluoran, with 3-dibutylamino-7-o-fluoroanilinofluoran being particularly preferred.

The color former represented by the general formula (I) which is used in the present invention can be used in combination with other color formers.

Specific examples of the compound represented by the general formula (II) include bis(p-hydroxyphenyl)-sulfone, bis-(3-aryl-4-hydroxyphenyl)sulfone, bis(2,5-dimethyl-4-hydroxy)sulfone, bis(2,5-diethyl-4-hydroxy)sulfone, bis(2,5-dipropyl-4-hydroxy)sulfone, bis(2,5-dibutyl-4-hydroxy)sulfone, bis(2,5-dibenzyl-4-hydroxy)sulfone, sulfone, bis(2,5-dimethoxy-4-hydroxy)sulfone, bis(2,5-diethoxy-4-hydroxy)sulfone, bis(2,5-dipropoxy-4-hydroxy)sulfone, bis(2,5-dibutoxy-4-hydroxy)sulfone, bis(2,5-diphenoxy-4-hydroxyphenyl)-sulfone, bis(2,5-dibenzyloxy-4-hydroxyphenyl)sulfone, bis(2,5-dimethoxycarbonyl-4-hydroxyphenyl)sulfone, bis(2,5-diethoxycarbonyl-4-hydroxyphenyl)sulfone, bis(2,5-diacetyl-4-hydroxyphenyl)sulfone, bis(2,5-dibenzoyl-4-hydroxyphenyl)sulfone, bis(4-hydroxy-3-nitro)sulfone, bis(3-cyano-4-hydroxy)sulfone, 5-ethyl-4-hydroxy-2-methylphenyl 4'-hydroxy-2'-methoxy-5'-methylphenyl sulfone, 5'ethoxy-4-hydroxy-2-methylphenyl 5'-ethyl-2'-ethoxy-4'-hydroxyphenyl sulfone, and 5-benzyloxy-4-hydroxy-2-methylphenyl 4'-hydroxy-2'-methoxy-5'-methylphenyl sulfone.

The developer represented by the general formula (II) which is used in the present invention can be used in combination with other developers.

According to the above-described combination of the color former with the developer, the plasticizer resistance, water resistance and oil resistance are improved to a considerable extent, but when brought into contact with a plastic film containing a plasticizer, water or an oil for a long period of time, there was observed a tendency of decolorization of the color-formed portion. Further, the surface strength of the heat-sensitive, color-forming layer is still weak, and even though in order to improve the surface strength, a styrene/butadiene copolymer used in coated paper was applied as a binder, the residue build-up and sticking occurred.

In order to improve these points, the present inventors have made further extensive investigations and found that such an object can be obtained by using, as a binder for the heat-sensitive, color-forming layer, an ammonium salt of a diisobutylene/maleic anhydride copolymer (preferably one mol of a diisobutylene group being reacted with one mol of a maleic anhydride group) represented by the following general formula (III):

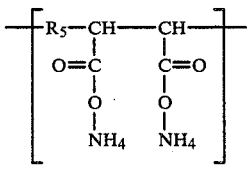

(III)

wherein $R_5$ represents an isobutylene group, together with a styrene/butadiene copolymer (the styrene content being preferably from 58 to 62 mol %) represented by the following general formula (IV):

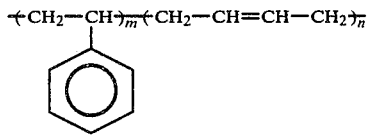

(IV)

As the ammonium salt of diisobutylene/maleic anhydride copolymer used as the binder in the present invention, those having a molecular weight of from 10,000 to 200,000 are suitable, and one having one mol of an isobutylene group bonded to one mol of a maleic anhydride group is particularly effective for improving the preservability. Further, the styrene/butadiene copolymer has an effect for improving the surface strength of the heat-sensitive, color-forming layer, and one having a styrene content of from 58 to 62 mol % is particularly effective for the improvement in surface strength of the heat-sensitive, color-forming layer. If the styrene content is too high, the heat-sensitive, color-forming layer becomes rigid to cause a reduction in surface strength, whereas if the butadiene content is too high, the residue build-up and sticking readily occur upon printing by means of a thermal head.

With respect to the binder, a combination use of the ammonium salt of diisobutylene/maleic anhydride copolymer with the styrene/butadiene copolymer is essential in the present invention. If only the ammonium salt of diisobutylene/maleic anhydride copolymer is used, the surface strength of the heat-sensitive, color-forming layer is low, whereas if only the styrene/-butadiene copolymer is used, the plasticizer resistance is low and the residue build-up and sticking readily occur. Suitably, from 0.5 to 1.0 part by weight of the styrene/-butadiene copolymer is mixed with one part by weight of the ammonium salt of diisobutylene/maleic anhydride copolymer. Further, the binder of the present invention can be used in combination with other binders such as polyvinyl alcohol, hydroxyethyl cellulose, carboxymethyl cellulose, starch, etc.

The heat-sensitive, color-forming layer of the present invention can be formed by known methods. As the support, a sheet-like material, such as paper, synthetic paper or plastic films, can be used. Onto one side of the support is coated a coating solution containing the above-described fluoran derivative, bis(p-hydroxyphenyl)sulfone and binder, to thereby form a heat-sensitive, color-forming layer.

If desired, the heat-sensitive, color-forming layer can contain known auxiliary additives such as fine white pigments such as calcium carbonate, talc, clay, silica, titanium oxide, and urea/formalin resin, and heat-fusible substances such as various waxes, higher fatty acid metal salts, and higher fatty acid amides, to thereby improve the sharpness of the color-formed image.

On the other hand, on the other side of the support is provided a pressure-sensitive adhesive layer by known methods such that it can be adhered to plastic films or wrapping paper, and a release substrate is laminated to the back side thereof. There can be thus obtained a heat-sensitive recording type, self-adhesive label.

The thus obtained heat-sensitive recording material according to the present invention excels in recording properties and environmental stability of the heat-sensitive, color-forming layer, without residue build-up and sticking during the printing. Furthermore, the heat-sensitive recording type self-adhesive label obtained by applying a pressure-sensitive adhesive onto the back side of the support using the heat-sensitive recording material of the present-invention is more excellent than ever.

The present invention will now be explained in more detail with reference to the examples, but it is to be understood that the invention is not limited thereto.

EXAMPLE 1

The following components were mixed together for 24 hours in a ball mill to prepare dispersions A and B.

| Dispersion A: | parts by weight |
|---|---|
| 3-Dibutylamino-7-o-fluoroanilino-fluoran | 1.0 |
| 20% Polyvinyl alcohol | 5.0 |
| Water | 44.0 |

| Dispersion B: | parts by weight |
|---|---|
| Bis(p-hydroxyphenyl)sulfone | 4.0 |
| Calcium carbonate | 3.0 |
| Stearamide | 1.0 |
| 20% Polyvinyl alcohol | 10.0 |
| Water | 32.0 |

The dispersions A and B were mixed together with as a binder a mixture of 6 parts by weight of a 20% diisobutylene/maleic anhydride copolymer ammonium salt aqueous solution (molecular weight: about 50,000) and 1.6 parts by weight of a 50% styrene/butadiene copolymer latex (molar percentage of styrene: 58 to 62%), and the mixture was coated on one side of wood free paper (basis weight: 50 g/m$^2$) and then dried to form a heat-sensitive, color-forming layer. There was thus obtained a heat-sensitive recording material according to the present invention.

EXAMPLE 2

The following components were mixed together for 24 hours in a ball mill to prepare dispersions A and B.

| Dispersion A: | parts by weight |
|---|---|
| 3-Dibutylamino-7-o-fluoranilino-fluoran | 1.0 |
| 20% Polyvinyl alcohol | 5.0 |
| Water | 44.0 |

| Dispersion B: | parts by weight |
|---|---|
| Bis-(3-aryl-4-hydroxyphenyl)sulfone | 4.0 |
| Calcium carbonate | 3.0 |
| Stearamide | 1.0 |
| 20% Polyvinyl alcohol | 10.0 |
| Water | 32.0 |

The dispersions A and B were mixed together with as a binder a mixture of 6 parts by weight of a 20% diisobutylene/maleic anhydride copolymer ammonium salt aqueous solution (molecular weight: about 50,000) and 1.6 parts by weight of a 50% styrene/butadiene copolymer latex (molar percentage of styrene: 58 to 62%), and the mixture was coated on one side of wood free paper (basis weight: 50 g/m$^2$) and then dried to form a heat-sensitive, color-forming layer. There was thus obtained a heat-sensitive recording material according to the present invention.

COMPARATIVE EXAMPLE 1

Heat-sensitive recording materials 1-A and 1-B for comparison were obtained in the same manner as in Example 1 except that the 3-dibutylamino-7-o-fluoroanilinofluoran used in the dispersion A was replaced by 3-diethylamino-7-p-chloroanilinofluoran and 3-(N-methyl-N-cyclohexylamino)-6-methyl-7-anilino-fluoran, respectively.

COMPARATIVE EXAMPLE 2

A heat-sensitive recording material for comparison was obtained in the same manner as in Example 1 except that the bis(p-hydroxyphenyl)sulfone used in the dispersion B was replaced by 4,4'-isopropylidene diphenol.

COMPARATIVE EXAMPLE 3

A heat-sensitive recording material for comparison was obtained in the same manner as in Example 1 except that 10 parts by weight of a 20% diisobutylene/maleic anhydride copolymer ammonium salt aqueous solution was used as the binder.

COMPARATIVE EXAMPLE 4

A heat-sensitive recording material for comparison was obtained in the same manner as in Example 1 except that 4 parts by weight of a 50% styrene/butadiene copolymer latex was used as the binder.

COMPARATIVE EXAMPLE 5

A heat-sensitive recording material for comparison was obtained in the same manner as in Example 1 except that a mixture of 2.5 parts by weight of a 20% diisobutylene/maleic anhydride copolymer ammonium salt aqueous solution and 3 parts by weight of a 50% styrene/butadiene copolymer latex was used as the binder.

On the back side of each of the heat-sensitive recording materials was laminated a silicone resin-coated release paper having thereon an acrylic-based pressure-sensitive adhesive layer at a coverage of 20 g/m$^2$, through the pressure-sensitive adhesive layer, and the laminate was cut off into a suitable size to obtain a heat-sensitive self-adhesive label.

The thus obtained seven heat-sensitive self-adhesive labels were printed by means of a label printer (HP-9303, made by Tokyo Denki K.K.), whereby a color formation test, a residue build-up and sticking test, a environmental stability test, and a surface strength test were carried out.

The results are shown in the following table.

TABLE

| | Color Density | Background Density | Residue Build-Up Sticking | Plasticizer Resistance After Covering | Water Resistance After Dipping | Oil Resistance After Applying | Surface Strength |
|---|---|---|---|---|---|---|---|
| Example 1 | 1.23 | 0.09 | o | 1.10 | 1.20 | 1.22 | o |
| Example 2 | 1.26 | 0.09 | o | 1.15 | 1.24 | 1.23 | o |
| Comparative Example 1-A | 1.20 | 0.09 | o | 0.38 | 0.45 | 0.50 | o |
| Comparative Example 1-B | 1.25 | 0.25 | o | 1.13 | 1.20 | 1.23 | o |
| Comparative Example 2 | 1.24 | 0.09 | o | 0.30 | 0.65 | 0.62 | o |
| Comparative Example 3 | 1.21 | 0.10 | o | 1.13 | 1.18 | 1.20 | x |
| Comparative Example 4 | 0.95 | 0.08 | x | 0.50 | 1.21 | 0.80 | o |
| Comparative Example 5 | 1.15 | 0.09 | x | 0.72 | 1.05 | 1.08 | o |

o: Good
x: Poor

Each of the tests was carried out in the following manner.

Color Density

The color formation was carried out by printing by means of a label printer, and the color-formed portion was measured by a Macbeth densitometer RD-514. (Hereinafter, the densities were all measured by the Macbeth densitometer RD-514.)

Background Density

The density of the background portion was measured.

Plasticizer Resistance

A portion which had been subjected to color formation by printing by means of the label printer was covered by a soft polyvinyl chloride film and after standing at room temperature for 24 hours, the density thereof was measured.

Water Resistance

A portion which had been subjected to color formation by printing by means of the label printer was dipped in water at room temperature for 24 hours, and the density thereof was then measured.

Oil Resistance

A portion which had been subjected to color formation by printing by means of the label printer was applied with a sesame oil, and after standing at room temperature for 24 hours, the density thereof was measured.

Surface Strength

The heat-sensitive recording material was printed with an ultraviolet light-curable ink (made by Toka Shikiso K.K.) by means of an RI tester (Akashi Seisakusho Co., Ltd.), and the transfer amount of the heat-sensitive, color-forming layer to the rubber roll side was observed.

It is clear from the above table that the heat-sensitive recording material according to the present invention Example 1 and 2 is of such a high quality that it is excellent in color formation, has a high whiteness in the background portion, is so good in environmental stability that the color does not disappear by the plasticizer, water, and oil, and is printable and free from residue build-up and sticking. On the other hand, in Comparative Examples 1-A and 2, the printed portion was decolorized by the plasticizer, oil and water and became unreadable; in Comparative Example 1-B, the background density was high as 0.25 and the image of the label was markedly reduced; in Comparative Example 3, although the density of the printed portion after the preservation test by the plasticizer, oil and water was 1.10 or more and a sharp image was kept, the surface strength was quite unsatisfactory; and in Comparative Examples 4 and 5, the printed portion was decolorized by the plasticizer and caused the residue build-up and sticking, and the recording materials cannot be put into practical use.

While the invention has been described in detail and with reference to specific embodiments thereof, it will be apparent to one skilled in the art that various changes and modifications can be made therein without departing from the spirit and scope thereof.

What is claimed is:

1. A heat-sensitive recording material comprising a support having thereon a heat-sensitive, color-forming layer mainly composed of as color-forming components a colorless or pale-colored leuco dye and an acidic compound capable of allowing said leuco dye to color develop by heating, wherein said heat-sensitive, color-forming layer comprises a color former comprising a fluoran derivative represented by the following general formula (I):

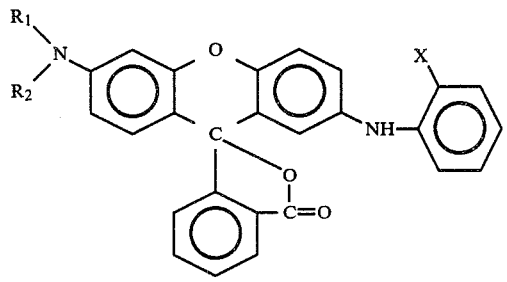

(I)

wherein $R_1$ and $R_2$ each represents a lower alkyl group, and X represents a halogen atom, a lower alkyl group, a cyano group, or a nitro group, a developer comprising bis(p-hydroxyphenyl)sulfone or a derivative thereof represented by the following general formula (II):

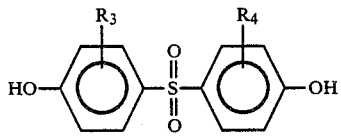

(II)

wherein $R_3$ and $R_4$ each represents a hydrogen atom, an alkyl group, an aryl group, an alkoxy group, a phenoxy group, a carbonyl group, a nitro group, or a cyano group, and a binder comprising an ammonium salt of a diisobutylene/maleic anhydride copolymer and a styrene/butadiene copolymer.

2. A heat-sensitive recording material as claimed in claim 1, wherein the amount of said styrene/butadiene copolymer in said binder is from 0.5 to 1.0 part by weight based on part by weight of said ammonium salt of diisobutylene/maleic anhydride copolymer.

* * * * *